US010895153B2

(12) United States Patent
Jiang et al.

(10) Patent No.: US 10,895,153 B2
(45) Date of Patent: Jan. 19, 2021

(54) VIBRATING TYPE HARD ROCK CUTTING MECHANISM WITH FUNCTION OF DIRECTIONAL HIGH-SPEED ABRASIVE JET ADVANCED SLITTING

(71) Applicants: China University of Mining and Technology, Jiangsu (CN); JIANGSU KAMPF MECHANICAL TECHNOLOGY CO., LTD, Jiangsu (CN)

(72) Inventors: Hongxiang Jiang, Jiangsu (CN); Zhengwei Hu, Jiangsu (CN); Songyong Liu, Jiangsu (CN)

(73) Assignees: China University of Mining and Technology, Jiangsu (CN); JIANGSU KAMPF MECHANICAL TECHNOLOGY CO., LTD, Jiangsu (CN)

( * ) Notice: Subject to any disclaimer, the term of this patent is extended or adjusted under 35 U.S.C. 154(b) by 0 days.

(21) Appl. No.: 16/631,169

(22) PCT Filed: Sep. 14, 2018

(86) PCT No.: PCT/CN2018/105722
§ 371 (c)(1),
(2) Date: Jan. 15, 2020

(87) PCT Pub. No.: WO2019/200827
PCT Pub. Date: Oct. 24, 2019

(65) Prior Publication Data

US 2020/0223098 A1 Jul. 16, 2020

(30) Foreign Application Priority Data

Apr. 18, 2018 (CN) ..... 2018 1 0348455

(51) Int. Cl.
*E21C 25/60* (2006.01)
*E21D 9/10* (2006.01)
*E21C 25/20* (2006.01)
*B28D 1/22* (2006.01)

(52) U.S. Cl.
CPC ..... *E21D 9/1066* (2013.01); *E21C 25/20* (2013.01); *B28D 1/22* (2013.01)

(58) Field of Classification Search
CPC ..... E21D 9/1066; E21C 25/60
See application file for complete search history.

(56) References Cited

U.S. PATENT DOCUMENTS 3,563,324 A * 2/1971 Lauber ..... E21C 35/187 175/393
4,314,730 A * 2/1982 Plumpton ..... E21D 9/1066 175/67

(Continued)

FOREIGN PATENT DOCUMENTS

CN 203822317 9/2014
CN 107630699 1/2018

(Continued)

OTHER PUBLICATIONS

Machine translation of CN107630699, accessed Sep. 18, 2020.*

(Continued)

*Primary Examiner* — Janine M Kreck
(74) *Attorney, Agent, or Firm* — JCIPRNET

(57) ABSTRACT

A vibrating type hard rock cutting mechanism with a function of directional high-speed abrasive jet advanced slitting includes a disc-shaped hob, a cutting main shaft and a valve plate. When the vibrating type hard rock cutting mechanism works, an outlet of a high-pressure abrasive jet generating system is communicated to a cutting mechanism abrasive jet inlet. An abrasive jet enters an abrasive jet nozzle through flow channels in the valve plate, the cutting main shaft and (Continued)

the disc-shaped hob and forms a directional high-speed abrasive jet. The cutting main shaft is directly driven to rotate by an axial permanent magnet motor. The cutting mechanism enables the disc-shaped hob to vibrate under the action of a vibration motor. A macro crack is formed on a rock mass by rotating the abrasive jet. The rotating disc-shaped hob can be wedged into the formed crack in a vibration manner by swinging the cutting mechanism.

6 Claims, 3 Drawing Sheets

(56) References Cited

U.S. PATENT DOCUMENTS 4,660,891 A * 4/1987 Kramer-Wasserka ..... E21C 35/23 299/81.2
2018/0087379 A1 3/2018 Lugg et al.

FOREIGN PATENT DOCUMENTS

DE 2836627 B1 * 11/1979 ..... E21C 35/22
DE 3148826 A1 * 6/1983 ..... E21C 25/60
GB 2016558 A * 9/1979 ..... E21C 25/60

OTHER PUBLICATIONS

"International Search Report (Form PCT/ISA/210) of PCT/CN2018/105722", dated Dec. 10, 2018, with English translation thereof, pp. 1-4.

* cited by examiner

VIBRATING TYPE HARD ROCK CUTTING MECHANISM WITH FUNCTION OF DIRECTIONAL HIGH-SPEED ABRASIVE JET ADVANCED SLITTING

CROSS-REFERENCE TO RELATED APPLICATION

This application is a 371 of international application of PCT application Ser. No. PCT/CN2018/105722, filed on Sep. 14, 2018, which claims the priority benefit of China application no. 201810348455.0, filed on Apr. 18, 2018. The entirety of each of the above mentioned patent applications is hereby incorporated by reference herein and made a part of this specification.

BACKGROUND

Technical Field

The present invention relates to a vibrating type hard rock cutting mechanism with a function of directional high-speed abrasive jet advanced slitting, which is suitable for tunneling hard rock roadways and tunnels.

Description of Related Art

Energy industry is a basic industry of the national economy and is a technology-intensive industry. "Safe, efficient and low-carbon" epitomizes the characteristics of a modern energy technology and is the main direction to seize the commanding heights of future energy technologies. The National Energy Technology "Twelfth Five-Year Plan" calls for strengthening the capacity of independent innovation, uses unlimited technologies to overcome the constraints of limited energy and resources, focusing on improving the safe and efficient development of energy resources, promoting the transformation of energy production and utilization manners, and planning to take an energy exploration and mining technology as one of four key development areas, and clearly requires the development of safe, efficient, economical and environment-friendly resource mining technologies and equipment under complex geological conditions, such as the development of a heading machine suitable for rock compressive strength of 100 MPa, and an efficient down-hole power and rock breaking system. With the wide application of various rock excavation machines in practical projects such as mining, tunneling, and oil and gas well drilling, higher requirements and new challenges are put forward for a hard rock breaking technology. Mechanical rock breaking has the advantages of large breaking block, high working efficiency and the like, and has been widely used in mining, construction engineering, resource exploration and other fields. However, in the construction of hard rock mass excavation, tool wear for existing equipment is increased, and the reliability and the working efficiency are reduced. How to achieve efficient breaking of a hard rock has become an urgent problem and puzzle to be solved. It is urgent to study a new rock breaking method to achieve efficient breaking of a hard rock, which is of great significance for the efficient mining of mines, the efficient tunneling of tunnels and the efficient development of energy resources in China.

In the past, mechanical hardening of a hard rock was achieved mainly by increasing the mechanical driving power, but the rock breaking capacity of mechanical pick did not change. Only increasing the power would cause the wear of a rock breaking mechanism to be intensified and the amount of working dust to be increased, thereby making it difficult to effectively improve the mechanical rock breaking efficiency, and increasing safety hazards.

SUMMARY

Object of the Invention: In order to overcome the deficiencies in the prior art, the present invention provides a vibrating type hard rock cutting mechanism with a function of directional high-speed abrasive jet advanced slitting. A crack surface is first formed on a cutting path of a disc-shaped hob by using a high-pressure abrasive jet, so as to greatly reduce the cutting impedance of a rock mass. The disc-shaped hob is cut into the crack surface of the rock mass. The disc-shaped hob vibrates and cuts the crushed rock mass under the combined action of a vibration motor, so as to greatly improve the mechanical rock breaking efficiency and capability. The mechanism can solve the problems of severe wear of equipment, low rock breaking efficiency, large amount of dust, and the like in the case of a hard rock mass in the construction process of roadways or tunnels, thereby achieving safe, efficient and low-cost tunneling of hard rock mass roadways.

Technical Solution

In order to achieve the above object, the present invention adopts the following technical solutions.

A vibrating type hard rock cutting mechanism with a function of directional high-speed abrasive jet advanced slitting includes a disc-shaped hob, a cutting main shaft and a valve plate. An outer side of the valve plate is provided with an abrasive jet inlet, an inner side of the valve plate is provided with an arc-shaped groove flow channel, and the abrasive jet inlet and the arc-shaped groove flow channel are communicated by a first flow channel. The inner side of the valve plate and both sides of the arc-shaped groove flow channel are provided with a rotating dynamic seal ring groove, an O-ring is mounted in the rotating dynamic seal ring groove, and a sealing connection between the valve plate and the cutting main shaft is achieved by the O-ring. A group of second flow channels are evenly arranged in the cutting main shaft, and one or more of the second flow channels are always maintained to be communicated to the arc-shaped groove flow channel during the rotation of the cutting main shaft. The disc-shaped hob includes a cutter body and a group of alloy cutter heads. A group of third flow channels are arranged in the cutter body. The third flow channels or branches of the third flow channels extend to an edge position of the cutter body. Cuts are processed at a corresponding position to inlay abrasive jet nozzles. The alloy cutter heads are mounted between the adjacent abrasive jet nozzles circumferentially. The cutter body is fixed to a front end of the cutting main shaft through a first fastening bolt to ensure connection between the third flow channels and the second flow channels.

Preferably, the arc-shaped groove flow channel has an arc angle of 60°~180°.

Preferably, a first static seal ring groove is provided at a joint position between the cutter body and the cutting main shaft, and a rubber O-ring is mounted in the static seal ring groove I.

Preferably, the O-ring mounted in the dynamic seal ring groove is a polytetrafluoroethylene O-ring.

Preferably, a number of the second flow channels is 2~4.

Preferably, a bearing end cover, a main shaft housing, an axial permanent magnet motor and a vibration motor are further included. The cutting main shaft is rotationally connected with respect to the main shaft housing through a first radial bearing, a thrust bearing and a second radial bearing. The valve plate and the bearing end cover are fixed to front and rear ends of the main shaft housing through a second fastening bolt and a third fastening bolt, respectively. The first radial bearing, the thrust bearing and the second radial bearing are sealed within a sealed space formed by the cutting main shaft and the main shaft housing through the valve plate and the bearing end cover. The cutting main shaft is radially fixed in conjunction with a stepped structure of the cutting main shaft, a stepped structure of the main shaft housing and a backing ring. The axial permanent magnet motor and the vibration motor are fixed to the main shaft housing through a fourth fastening bolt and a fifth fastening bolt, respectively. An output shaft of the axial permanent magnet motor and a rear end of the cutting main shaft are connected by a spline.

Preferably, a support housing is further included. The main shaft housing is fixed to the support housing through a sixth fastening bolt.

When the cutting mechanism works, the axial permanent magnet motor is energized to make an internal spline shaft of the axial permanent magnet motor have a certain rotation speed and torque, and the internal spline of the axial permanent magnet motor is connected to an external spline at the rear end of the cutting main shaft to make the cutting main shaft have a certain rotation speed and torque. The cutting main shaft is supported in the main shaft housing through the first radial bearing, the second radial bearing, the thrust bearing and the backing ring, so that the cutting main shaft can bear a rotation torque and an axial thrust simultaneously. The cutting main shaft is fixedly connected to the disc-shaped hob through the first fastening bolt, so that the disc-shaped hob has a certain rotation speed and torque. The vibration motor is fixed to the main shaft housing through the fifth fastening bolt, and the cutting mechanism vibrates during operation to drive the disc-shaped hob to vibrate. The cutter body of the disc-shaped hob is evenly inlaid with a plurality of abrasive jet nozzles and alloy cutter heads radially, so that the disc-shaped hob has both mechanical and water jet rock breaking functions. The valve plate is fixed to the front end of the main shaft housing through the second fastening bolt, and the abrasive jet inlet of the valve plate, the first flow channel, the arc-shaped groove flow channel, the second flow channels, the third flow channels and the abrasive jet nozzles are connected and communicated in sequence. When a second certain flow channel is communicated to the arc-shaped groove flow channel, the third flow channel and the abrasive jet nozzle communicated to the second flow channel are in a working state to form a high-speed abrasive jet, and other non-communicated abrasive jet nozzles are in a non-working state. Various second flow channels are not communicated to one other, and are sequentially communicated to the arc-shaped groove flow channel one by one during the rotation of the cutting main shaft. A high-speed abrasive jet can be formed only in the direction of contact between the disc-shaped hob and a rock, thereby greatly saving the water and abrasive consumption of the high-pressure abrasive jet. When the cutting mechanism is connected to the high-pressure abrasive jet, the axial permanent magnet motor and the vibration motor are started, and the rotating directional abrasive jet and the alloy cutter heads cooperate to complete vibration cutting and breaking of a hard rock.

Advantageous Effect

When the vibrating type hard rock cutting mechanism with a function of directional high-speed abrasive jet advanced slitting provided by the present invention works, a rotating directional abrasive jet pre-slits a contact between a disc-shaped hob and a rock, and then the disc-shaped hob that vibrates rotationally extrudes and stretches a rock mass along the pre-slit. The efficient vibration cutting and breaking of the rock can be completed by using the non-tensile characteristics of a hard rock mass, thereby greatly reducing the rock breaking difficulty of the disc-shaped hob, and improving the breaking efficiency of the hard rock mass. The mechanism and the rock breaking process not only can reduce the breaking difficulty of the hard rock mass and improve the breaking efficiency of the hard rock mass, but also can avoid excessive wear of the disc-shaped hob, which is of great significance for achieving efficient tunneling of hard rock roadways and tunnels.

In which, 1, disc-shaped hob; 2, first fastening bolt; 3, cutting main shaft; 4, second fastening bolt; 5, valve plate; 6, main shaft housing; 7, first radial bearing; 8, backing ring; 9, thrust bearing; 10, second radial bearing; 11, bearing end cover; 12, third fastening bolt; 13, radial permanent magnet motor; 14, fourth fastening bolt; 15, vibration motor; 16, support housing; 17, fifth fastening bolt; 18, sixth fastening bolt; 19, lubricating oil; 20, high-speed abrasive jet; 1-1, cutter body; 1-2, abrasive jet nozzle; 1-3, cut; 1-4, alloy cutter head; 1-5, cylindrical boss; 1-6, static seal ring groove I; 1-7, sinking through hole; 1-8, third flow channel; 3-1, second flow channel; 3-2, cylindrical groove; 3-3, internal threaded hole; 3-4, external spline; 5-1, abrasive jet inlet; 5-2, first flow channel; 5-3, rotating dynamic seal ring groove; 5-4, second static seal ring groove; 5-5, inner hole; 5-6, arc-shaped groove flow channel; 5-7, stepped through hole; and 13-1, internal spline shaft.

DESCRIPTION OF THE EMBODIMENTS

The present invention will be further described below with reference to the accompanying drawings.

Figure 1:
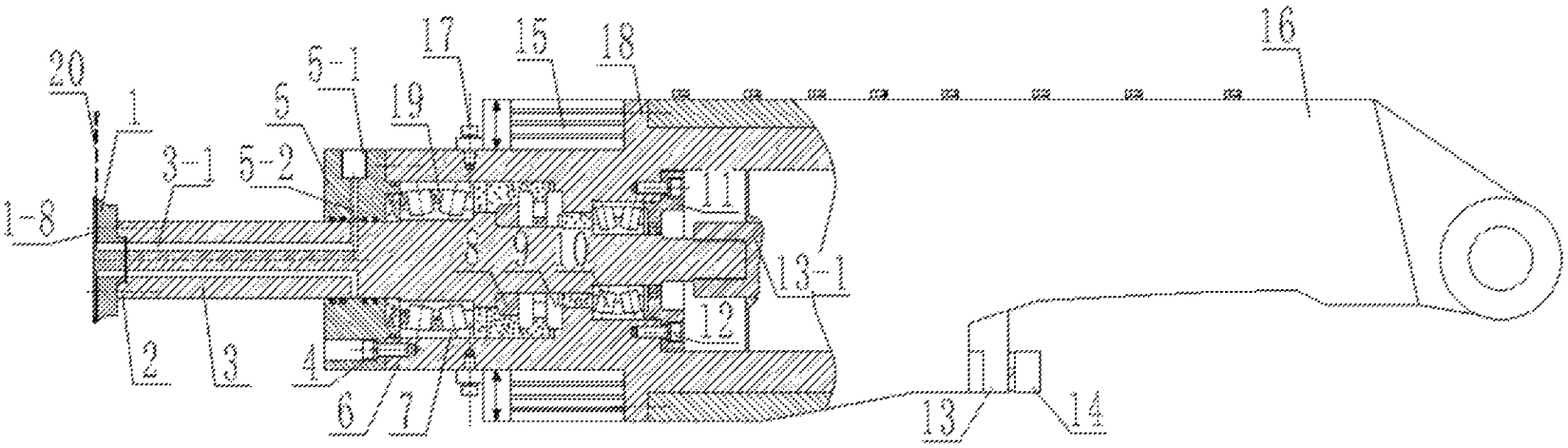
FIG. 1 is a schematic structure view of the present invention.

As shown in FIG. 1, a vibrating type hard rock cutting mechanism with a function of directional high-speed abrasive jet advanced slitting includes a disc-shaped hob 1, a cutting main shaft 3, a valve plate 5, a bearing end cover 11, a main shaft housing 6, a support housing 16, an axial permanent magnet motor 13, and a vibration motor 15. The main shaft housing 6 serves as a link for other components of the cutting mechanism. The axial permanent magnet motor 13, a housing and the vibration motor 15 are fixed to the main shaft housing 6 through a fourth fastening bolt 14 and a fifth fastening bolt 17, respectively. When the axial permanent magnet motor 13 works, an internal spline shaft 13-1 outputs a certain rotation speed and torque. When the vibration motor 15 works, an excitation force is output onto the main shaft housing 6.

An internal spline shaft 13-1 of the axial permanent magnet motor 13 cooperates with an external spline 3-4 at a rear end of the cutting main shaft 3. The disc-shaped hob 1 is fixed to a front end of the cutting main shaft 3 through a first fastening bolt 2. When the axial permanent magnet motor 13 works, an output rotation motion and torque are sequentially transferred to the cutting main shaft 3 and the disc-shaped hob 1. An external high-pressure abrasive jet system forms a high-speed abrasive jet 20 through an abrasive jet inlet 5-1, a first flow channel 5-2 and an arc-shaped groove flow channel 5-6 of the valve plate 5, a second flow channel 3-1 of the cutting main shaft 3, a third flow channel 1-8 of the disc-shaped hob 1, and an abrasive jet nozzle 1-2. When the axial permanent magnet motor 13, the vibration motor 15 and the external high-pressure abrasive jet system simultaneously work, the high-speed abrasive jet 20 can be combined with the disc-shaped hob 1 to break a rock.

Figure 2:
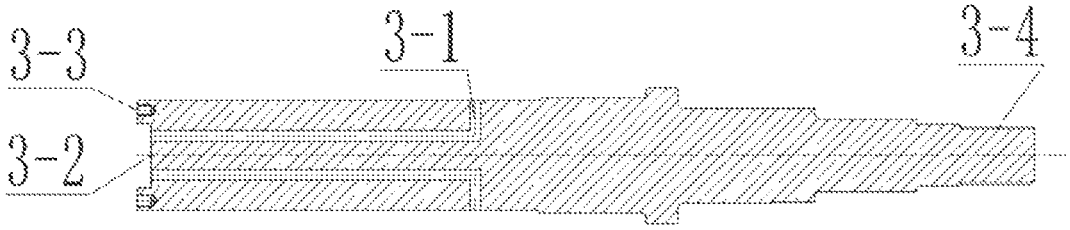
FIG. 2 is a cross-sectional schematic structure view of a cutting main shaft.
Figure 3:
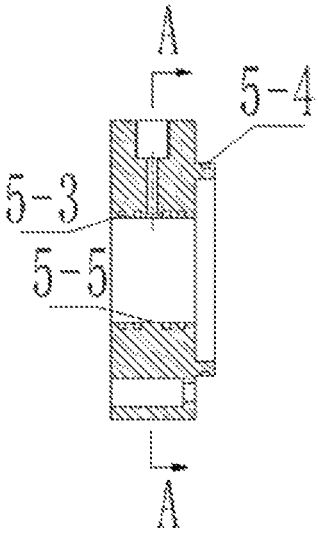
FIG. 3 is a cross-sectional schematic structure view of a valve plate.
Figure 4:
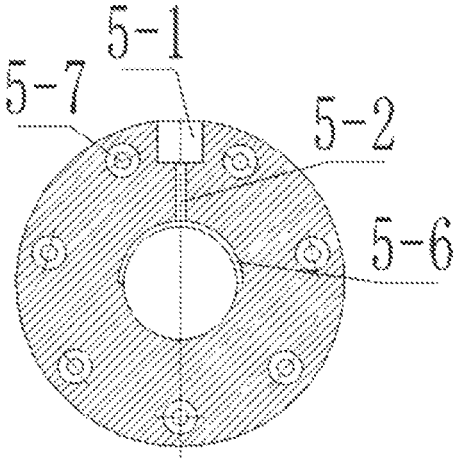
FIG. 4 is a schematic structure view of a section A-A in FIG. 3.

In FIG. 2 to FIG. 4, the cutting main shaft 3 and the valve plate 5 are shown. The cutting main shaft 3 is processed with independent right-angled second flow channels 3-1. The valve plate 5 is processed with an abrasive jet inlet 5-1, a first flow channel 5-2, a plurality of rotating dynamic seal ring grooves 5-3, and a second static seal ring groove 5-4. An inner hole 5-5 of the valve plate 5 is processed with an arc-shaped groove flow channel 5-6, and the first flow channel 5-2 is communicated to the arc-shaped groove flow channel 5-6. Preferably, the arc-shaped groove flow channel 5-6 has an arc angle of 60°~180°. During operation, the right-angled second flow channels 3-1 of the cutting main shaft 3 are in clearance connection with the arc-shaped groove flow channel 5-6. An abrasive jet therebetween is mounted in the plurality of rotating dynamic seal ring grooves 5-3 and sealed by a polytetrafluoroethylene O-ring. The cutting main shaft 3 introduces an abrasive jet once to the independent right-angled second flow channels 3-1 every revolution, respectively.

Figure 5:
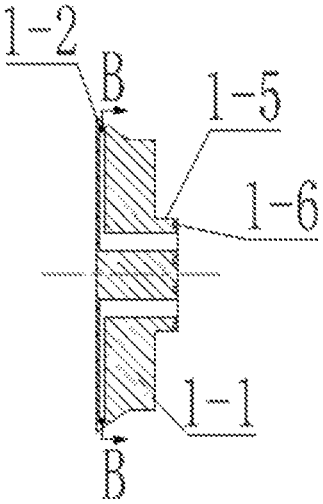
FIG. 5 is a cross-sectional schematic structure view of a disc-shaped hob.
Figure 6:
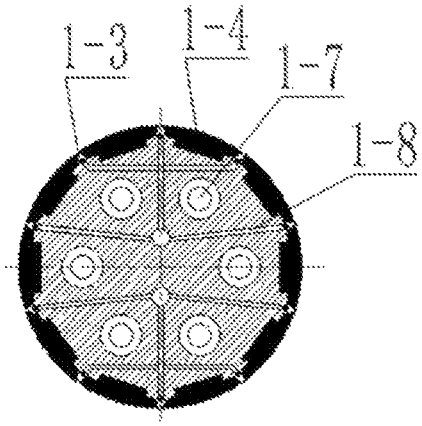
FIG. 6 is a schematic structure view of a section B-B in FIG. 5.

In FIG. 5 and FIG. 6, the disc-shaped hob 1 is shown. A cutter body 1-1 of the disc-shaped hob 1 is evenly inlaid with a plurality of abrasive jet nozzles 1-2 radially. Cuts 1-3 are processed at positions where the abrasive jet nozzles 1-2 are inlaid, respectively. The cutter body 1-1 is discretely inlaid with a plurality of alloy cutter heads 1-4 radially. The cutter body 1-1 is provided with a cylindrical boss 1-5 cooperating with a cylindrical groove 3-2 of the cutting main shaft 3. A static seal ring groove 1-6 is processed in an end surface of the cylindrical boss 1-5. The cutter body 1-1 is provided with a sinking through hole 1-7 for the first fastening bolt 2 axially. A third flow channel 1-8 correspondingly communicated to the second flow channel 3-1 of the cutting main shaft 3 is processed inside the cutter body 1-1. They are sealed by a rubber O-ring mounted in the first static seal ring groove 1-6. An abrasive jet introduced to the third flow channel 1-8 periodically from the second flow channel 3-1 of the cutting main shaft 3 forms a directional high-speed abrasive jet 20 through the abrasive jet nozzles 1-2.

As shown in FIG. 1 to FIG. 6, when the cutting mechanism works, the external high-pressure abrasive jet system forms a directional high-speed abrasive jet 20 under the combined action of the valve plate 5, the cutting main shaft 3 and the disc-shaped hob 1, and cuts a circular arc-shaped crack surface on a rock cutting path of the disc-shaped hob 1. At the same time, under the combined drive of the axial permanent magnet motor 13 and the vibration motor 15, the inlaid allow cutter heads 1-4 of the disc-shaped hob 1 are cut into the crack surface formed by cutting the high-speed abrasive jet 20 in a rotational vibration manner, thus extruding the crack surface to break a rock mass.

The principle of the vibrating type hard rock cutting mechanism with a function of directional high-speed abrasive jet advanced slitting of the present invention is as follows: when the cutting mechanism works, a working face power system supplies power to the axial permanent magnet motor 13 and the vibration motor 15, the powered axial permanent magnet motor 13 forms a rotation motion and torque that is output then by the internal spline shaft 13-1, the internal spline shaft 13-1 cooperates with the external spline 3-4 at the rear end of the cutting main shaft 3 to transfer the rotation motion and torque to the cutting main shaft 3, and the front end of the cutting main shaft 3 fixes, through the first fastening bolt 2, the disc-shaped hob 1 to make it have a certain rotation speed and torque, so that the disc-shaped hob 1 can break the rock by rotational cutting. Since the vibration motor 15 is fixed to the main shaft housing 6 through the fifth fastening bolt, the powered vibration motor 15 outputs an excitation force that is then sequentially transferred to the main shaft housing 6, the first radial bearing 7, the second radial bearing 10, the thrust bearing 9 and the cutting main shaft 3 to the disc-shaped hob 1, so that the disc-shaped hob 1 can cut the rock in a rotational vibration manner. After the external high-pressure abrasive jet system works, a high-pressure abrasive jet is formed into the high-speed abrasive jet 20 through the abrasive jet inlet 5-1, the first flow channel 5-2 and the arc-shaped groove flow channel 5-6 of the valve plate 5, the second flow channel 3-1 of the cutting main shaft 3, the third flow channel 1-8 of the disc-shaped hob 1, and the abrasive jet nozzle 1-2. Since the arc-shaped groove flow channel 5-6 preferably has an arc angle of 60°~180°, the right-angled second flow channel 3-1 of the cutting main shaft 3 that rotates during operation is in clearance connection with the arc-shaped groove flow channel 5-6. Only the arc-shaped groove flow channel 5-6, the right-angled second flow channel 3-1 of the cutting main shaft 3, the third flow channel 1-8 of the disc-shaped hob 1 and the abrasive jet nozzle 1-2 are continuously communicated to form the directional high-speed abrasive jet 20. By design, the directional high-speed abrasive jet 20 formed at any time is located on a contact path between the disc-shaped hob 1 and the rock mass. When the axial permanent magnet motor 13, the vibration motor 15 and the external high-pressure abrasive jet system simultaneously work, the formed directional high-speed abrasive jet 20 cuts an arc-shaped crack on the contact path between the disc-shaped hob 1 and the rock mass in advance. Then, the disc-shaped hob 1 is wedged into the arc-shaped crack in a rotational vibration manner. By fully utilizing the characteristic that a hard rock mass is easily fractured, the rock breaking capacity and efficiency of the disc-shaped hob 1 are greatly improved.

The above is only a preferred implementation manner of the present invention, and it should be noted that those of ordinary skill in the art can also make several improvements and modifications without departing from the principles of the present invention, which should be regarded as the scope of protection of the present invention.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A vibrating type hard rock cutting mechanism with a function of directional high-speed abrasive jet advanced slitting, comprising a disc-shaped hob, a cutting main shaft and a valve plate, wherein an outer side of the valve plate is provided with an abrasive jet inlet, an inner side of the valve plate is provided with an arc-shaped groove flow channel, and the abrasive jet inlet and the arc-shaped groove flow channel are communicated by a first flow channel; the inner side of the valve plate and both sides of the arc-shaped groove flow channel are provided with a rotating dynamic seal ring groove, an O-ring is mounted in the rotating dynamic seal ring groove, and a sealing connection between the valve plate and the cutting main shaft is achieved by the O-ring;

a group of second flow channels are evenly arranged in the cutting main shaft, and one or more of the second flow channels are always maintained to be communicated to the arc-shaped groove flow channel during rotation of the cutting main shaft; and the disc-shaped hob comprises a cutter body and a group of alloy cutter heads, a group of third flow channels are arranged in the cutter body, the third flow channels or branches of the third flow channels extend to an edge position of the cutter body, cuts are processed at a corresponding position to inlay abrasive jet nozzles, the alloy cutter heads are circumferentially mounted between the adjacent abrasive jet nozzles, and the cutter body is fixed to a front end of the cutting main shaft through a first fastening bolt to ensure connection between the third flow channels and the second flow channels, wherein a first static seal ring groove is provided at a joint position between the cutter body and the cutting main shaft, and a rubber O-ring is mounted in the first static seal ring groove.

2. The vibrating type hard rock cutting mechanism with a function of directional high-speed abrasive jet advanced slitting according to claim 1, wherein the arc-shaped groove flow channel has an arc angle of 60°~180°.

3. The vibrating type hard rock cutting mechanism with a function of directional high-speed abrasive jet advanced slitting according to claim 1, wherein the O-ring mounted in the rotating dynamic seal ring groove is a polytetrafluoroethylene O-ring.

4. The vibrating type hard rock cutting mechanism with a function of directional high-speed abrasive jet advanced slitting according to claim 1, wherein a number of the second flow channels is 2~4.

5. The vibrating type hard rock cutting mechanism with a function of directional high-speed abrasive jet advanced slitting according to claim 1, further comprising a bearing end cover, a main shaft housing, an axial permanent magnet motor and a vibration motor, wherein the cutting main shaft is rotationally connected with respect to the main shaft housing through a first radial bearing, a thrust bearing and a second radial bearing, the valve plate and the bearing end cover are fixed to front and rear ends of the main shaft housing through a second fastening bolt and a third fastening bolt, respectively, the first radial bearing, the thrust bearing and the second radial bearing are sealed within a sealed space formed by the cutting main shaft and the main shaft housing through the valve plate and the bearing end cover, the cutting main shaft is radially fixed in conjunction with a stepped structure of the cutting main shaft, a stepped structure of the main shaft housing and a backing ring, the axial permanent magnet motor and the vibration motor are fixed to the main shaft housing through a fourth fastening bolt and a fifth fastening bolt, respectively, and an output shaft of the axial permanent magnet motor and a rear end of the cutting main shaft are connected by a spline.

6. The vibrating type hard rock cutting mechanism with a function of directional high-speed abrasive jet advanced slitting according to claim 5, further comprising a support housing, the main shaft housing being fixed to the support housing through a sixth fastening bolt.

* * * * *